US006382626B1

(12) United States Patent
Ryff

(10) Patent No.: US 6,382,626 B1
(45) Date of Patent: May 7, 2002

(54) MODIFIED CHESS GAME

(76) Inventor: Anthony S. Ryff, 101 Executive Center Dr., W.P.B., FL (US) 33401

( * ) Notice: Subject to any disclaimer, the term of this patent is extended or adjusted under 35 U.S.C. 154(b) by 0 days.

(21) Appl. No.: 09/665,421

(22) Filed: Sep. 20, 2000

(51) Int. Cl.[7] ..... A63F 3/02
(52) U.S. Cl. ..... 273/260; 273/262
(58) Field of Search ..... 273/260, 261, 273/262; D21/348, 349

(56) References Cited

U.S. PATENT DOCUMENTS 5,511,793 A * 4/1996 Watt
5,692,754 A * 12/1997 Rostami ..... 273/261
5,954,333 A * 9/1999 Vilches Guerra
6,070,871 A * 6/2000 Wilson et al. ..... 273/261

* cited by examiner

*Primary Examiner*—Paul T. Sewell
*Assistant Examiner*—Stephen Blau
(74) *Attorney, Agent, or Firm*—Gold & Rizvi, P.A.; Glenn E. Gold; H. John Rizvi

(57) ABSTRACT

A modified chess game known as Royal Chess is disclosed in which the traditional king and queen pawns are replaced by shield pawns (42, 42A) possessing the traditional moves and characteristics of traditional pawns (40), plus the ability to move laterally one file in either direction of their rank.

1 Claim, 2 Drawing Sheets

MODIFIED CHESS GAME

FIELD OF THE INVENTION

This invention relates generally to board games, and more particularly to a modified chess game.

BACKGROUND OF THE INVENTION

The game of chess is played around the globe by millions of enthusiasts. The standard game of chess is played on a square game board divided into an eight-by-eight grid of alternately colored squares. Two sets of game pieces are arranged on opposite sides of the game board. The 'high value' pieces are arranged on the row furthest from the opponent. The 'lowest value' piece, the pawn, is arranged in a row directly in front of the latter. The objective is to place the opponent's king piece in a condition which is formed by positioning the high value pieces such that the opponents king piece cannot move without violating the high value pieces territory.

Unlike other sports, chess is constant in that the game is played the same throughout the world—same movements, same rules. All of the potential moves have been documented and, given time, one can find the best counter move for any scenario presented by an opponent. In fact, the moves and counter moves are so well known that computers have been developed that can play the game against humans or against another computer. Many advanced players study these materials and find that the excitement of the game is somewhat dulled.

Numerous innovations for modifying the conventional chess game have been provided in the prior art. Typically, such modifications have taken the form of additional play pieces and/or altered board layouts. For instance, examples of modified chess games are disclosed in U.S. Pat. Nos. 5,690,334; 5,735,523; 5,692,754; 5,901,957; 5,536,014; 5,421,582; and 4,033,586. Often, such modified chess games vary from conventional Chess to such a degree that many, if not a majority, of the basic moves and strategies learned by players through years of practice lose their relevance.

Accordingly, it would be desirable to provide a modified version of Chess wherein the modification expands upon the basic proven game by providing more of a challenge to the players while maintaining the effectiveness of most of the core moves and strategies.

SUMMARY OF THE INVENTION

A modified version of traditional chess, referred to as "Royal Chess," is played upon a conventional chess board 20 having an eight-by-eight square checkerboard pattern comprising files and rank. The game comprises traditional chess pieces initially set up on the board 20 pursuant to the rules of chess. On each player's second rank (the rank immediately forward of each player's back rank), each player has a row of eight pawns. Six of the pawns are traditional chess pawns 40, 40A, and two of the pawns, positioned directly in front of the king and queen, are "shield pawns" 42, 42A. The traditional chess pieces move pursuant to the traditional rules of chess. In addition to the traditional pawn movements and characteristics, each shield pawn can move laterally one file in either direction of its rank.

DETAILED DESCRIPTION OF THE PREFERRED EMBODIMENTS

Figure 1:
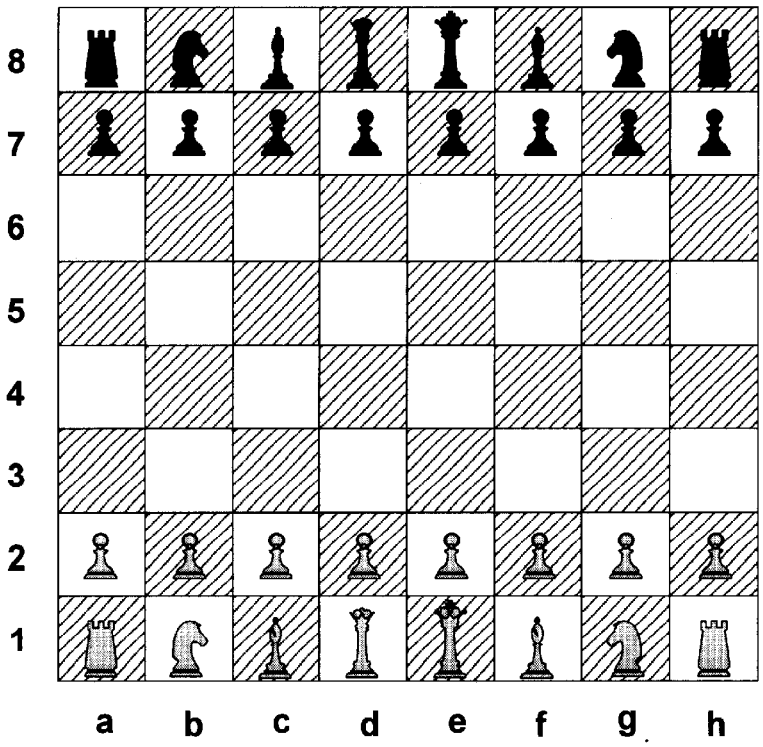
FIG. 1 (Prior Art)
FIG. 1 is a top view of a conventional prior art Chess board game.
Figure 2:
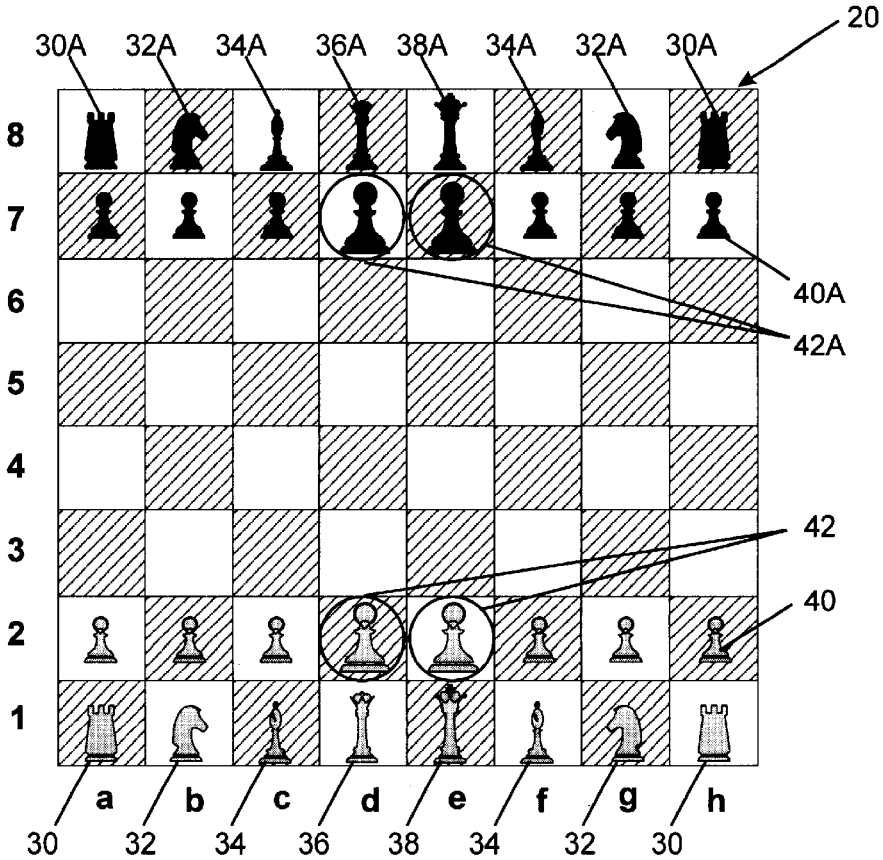
FIG. 2 is a top view of a modified Chess board game in accordance with the present invention.

Referring now to FIG. 2, the modified chess game of the present invention, referred to as "Royal Chess," is played upon a conventional chess board 20 having a checkerboard pattern comprising files and ranks. As used herein, the terms "files" and "ranks" are used in the same sense as they are used in the conventional game of chess to describe board positions. The eight files (rows that run left to right for White and right to left for Black) are indicated by small letters a, b, c, d, e, f, g and h, respectively. The eight ranks (columns that run from bottom to top for White and from top to bottom for Black) are numbered 1 through 8.

The game comprises traditional chess pieces initially set up on the board 20 pursuant to the rules of chess. That is, the player having the White pieces has pieces disposed on the player's back rank (a1 through h1)—the rank furthest away from the Black player's pieces—which include from left to right a rook 30, knight 32, bishop 34, queen 36, king 38, bishop 34, knight 32 and rook 30. The king 28 is disposed on a black square. The player having the Black pieces has on that player's back rank (a8 through h8) pieces consisting of, left to right from the White player's perspective, a rook 30A, knight 32A, bishop 34A, queen 36A, king 38A, bishop 34A, knight 32A and rook 30A. The king 38A of the player having the Black pieces is initially disposed on a white colored square.

On each player's second rank (the rank immediately forward of each player's back rank), each player has a row of eight pawns. Six of the pawns are traditional chess pawns 40, 40A. However, in the modified chess game of the present invention the two traditional pawns initially positioned directly in front of the king and queen are replaced with "shield pawns" 42, 42A. Preferably, the shield pawns are constructed to have a slightly greater height (e.g., 15%) than the traditional pawn pieces. With the exception of the shield pawns 42, 42A, which will be described in more detail below, each of the aforementioned traditional chess pieces moves pursuant to the traditional rules of chess.

Figure 3:
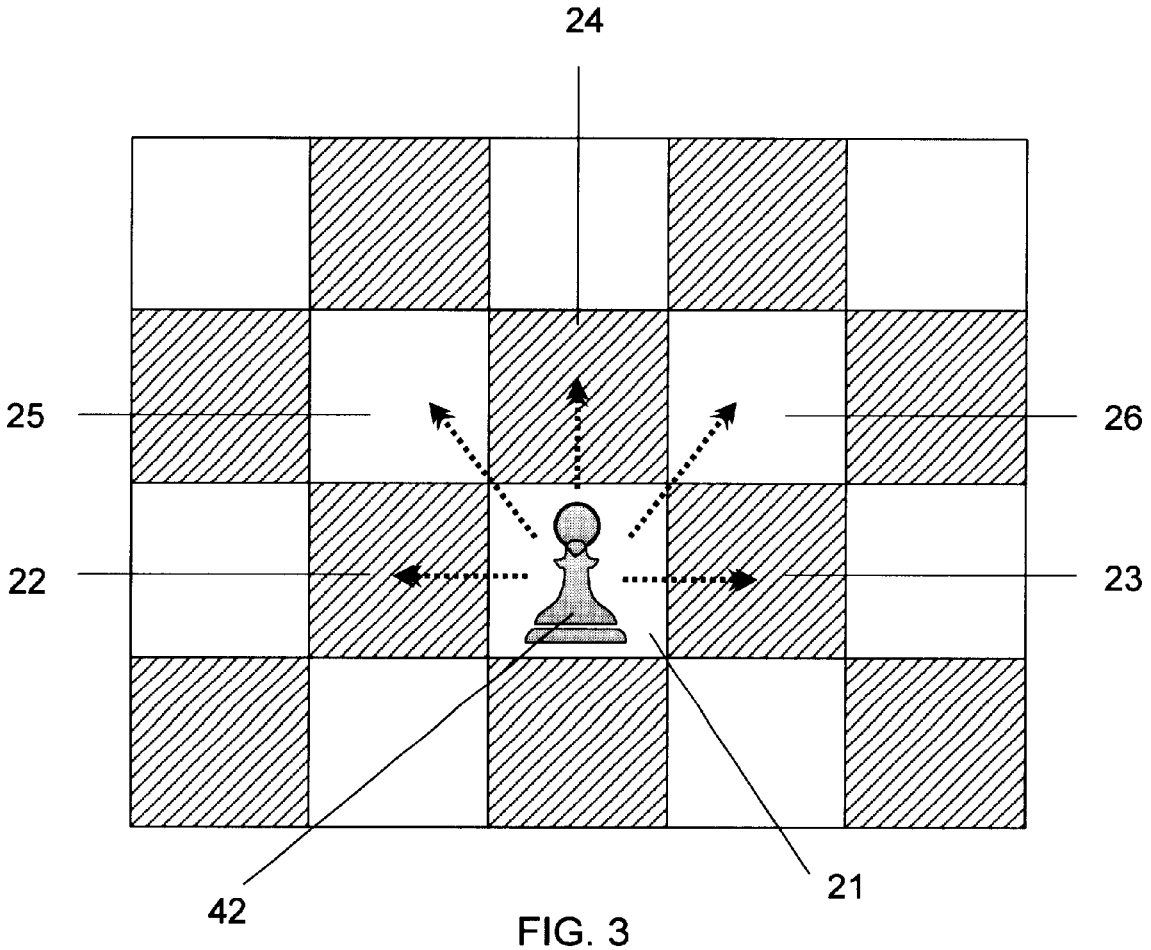
FIG. 3 is a top view of a section of board 20, illustrating the potential moves of a Shield pawn, 42, in accordance with the present invention.

Referring now to FIG. 3, a single White shield pawn 42 is shown isolated on a section of board 20 for the purpose of illustrating its potential moves. Each shield pawn 42 possesses all of the traditional pawn movements and characteristics. In particular, shield pawn 42 can move forward one square at a time into an unoccupied position, and diagonally forward one square to capture an opposing player's piece. Furthermore, if the shield pawn 42 has never moved, it has the option of moving either one or two squares forward. Also, like the traditional pawn, the shield pawn can be promoted to a piece of its own color upon reaching the opposing player's first rank. In addition to the these traditional movements, each shield pawn 42 can move laterally one file in either direction of its rank. Thus, shield pawn 42 can move forward from square 21 to square 24, or laterally from square 21 to either square 22 or square 23. Furthermore, shield pawn 42 can move diagonally from square 21 to either square 25 or 26 to capture an opposing Black piece.

The enhanced mobility of the shield pawns, vis-a-vis the traditional pawns, expands the offensive and defensive strategies of the opening, middle and end portions of the chess game. As a result, the traditional chess game strategies are expanded to provide a more interesting game, without entirely altering the way the game is played.

I claim:

1. A method of playing an advanced chess game for use by a player and an opposing player, wherein each player uses game pieces upon a shared game board, the method comprising the steps of:

providing a standard chess game board having an upper surface upon which the advanced game is to be played, said upper surface having an eight-by-eight grid of adjoining squares over which the game pieces are moved;

providing the game pieces comprising a set thereof to be used by a player and another set thereof to be used by the opposing player upon the game board, each set of pieces comprising a set of game pieces from a standard chess game and including eight pawn pieces;

arranging each set of game pieces on the board in accordance the rules of chess;

designating the traditional King pawn and Queen pawn pieces Shield pawns, each Shield pawn having a range of movement at any location on the game board including all of the same movements of traditional chess pawn pieces and an additional movement on the game board defined by moving away from a square first occupied thereby, in one of a left motion and a right motion to an unoccupied ending square one lateral position therefrom;

said Shield pawns comprising the only pawns having said additional movement.

* * * * *